US008419345B2

(12) United States Patent
Arnett et al.

(10) Patent No.: US 8,419,345 B2
(45) Date of Patent: Apr. 16, 2013

(54) ACTUATOR

(75) Inventors: Eric Mitchell Arnett, Columbus, IN (US); Ross Julian Belloni, Brownsburg, IN (US); Andrew Clifford Dalton, Tucson, AZ (US)

(73) Assignee: Rolls-Royce Corporation, Indianapolis, IN (US)

( * ) Notice: Subject to any disclaimer, the term of this patent is extended or adjusted under 35 U.S.C. 154(b) by 543 days.

(21) Appl. No.: 12/642,241

(22) Filed: Dec. 18, 2009

(65) Prior Publication Data

US 2010/0215483 A1 Aug. 26, 2010

Related U.S. Application Data

(60) Provisional application No. 61/203,912, filed on Dec. 30, 2008.

(51) Int. Cl.
*F04D 27/00* (2006.01)

(52) U.S. Cl.
USPC ..... 415/1; 415/18; 415/125; 415/160; 91/45

(58) Field of Classification Search ..... 415/1, 13, 415/14, 17, 18, 123, 150, 151, 159, 160; 91/42, 45, 445
See application file for complete search history.

(56) References Cited

U.S. PATENT DOCUMENTS

| | | | | |
|---|---|---|---|---|
| 2,938,501 | A * | 5/1960 | Titcomb | 415/51 |
| 4,608,911 | A * | 9/1986 | Johnson | 91/445 |
| 4,780,049 | A | 10/1988 | Palmer et al. | |
| 4,874,288 | A | 10/1989 | Kapich | |
| 5,303,549 | A * | 4/1994 | Berchtold et al. | 60/414 |
| 5,586,857 | A | 12/1996 | Ishii et al. | |
| 6,039,534 | A | 3/2000 | Stoner et al. | |
| 6,341,238 | B1 | 1/2002 | Modeen et al. | |
| 6,814,540 | B2 | 11/2004 | Sishtla et al. | |
| 7,000,392 | B2 * | 2/2006 | Greentree | 60/602 |
| 2003/0007865 | A1 * | 1/2003 | Chard et al. | 415/150 |
| 2003/0079474 | A1 | 5/2003 | Finger et al. | |
| 2003/0143067 | A1 | 7/2003 | Bouru | |
| 2004/0076513 | A1 | 4/2004 | Sishtla et al. | |

* cited by examiner

*Primary Examiner* — Edward Look
*Assistant Examiner* — William Grigos
(74) *Attorney, Agent, or Firm* — Krieg DeVault LLP

(57) ABSTRACT

In one embodiment a system is disclosed that includes an actuation device coupled with a turbomachinery mechanism. The actuation device can include multiple fluid pathways and a valve to alternatively place each of these pathways in fluid communication with a supply port while another of the pathways is in fluid communication with a return port to selectively move an actuation member along a range of travel. A brake valve may also be included to provide pressurized fluid to the actuation member when the actuation device is in an on condition and divert at least a portion of the pressurized fluid away from the actuation member through another pathway when the actuation device is in an off condition. A fluid-powered brake is coupled to this further pathway to selectively apply braking force to the actuation member in response to the diverted pressurized fluid.

23 Claims, 8 Drawing Sheets

ACTUATOR

CROSS REFERENCE TO RELATED APPLICATIONS

The present application claims the benefit of U.S. Provisional Patent Application 61/203,912, filed Dec. 30, 2008, and is incorporated herein by reference.

TECHNICAL FIELD

The technical field generally relates to actuation and/or drive subsystems, and more particularly, but not exclusively relates to controlling position of an actuator involved in the operation of turbomachinery when actuator power is removed.

BACKGROUND

Actuators are prevalent in many modern-day devices. In aircraft applications, the ability to provide a desired configuration of actuators can be of particular concern when an adverse impact on safety and/or performance may otherwise result. For example, unpredictable behavior of actuators used in gas turbine engines may jeopardize safety. Further, particularly in aircraft applications there is a desire to minimize the weight and complexity associated with actuator failsafe devices. Accordingly, there is an ongoing need for further contributions in this area of technology.

SUMMARY

One embodiment of the present invention includes a unique technique to operate an actuator. Other embodiments include unique apparatus, devices, systems, and methods for operation of an actuator involved with turbomachinery. Further embodiments, forms, objects, features, advantages, aspects, and benefits of the present application shall become apparent from the detailed description and drawings included herein.

DETAILED DESCRIPTION OF SELECTED EMBODIMENTS

Figure 1:
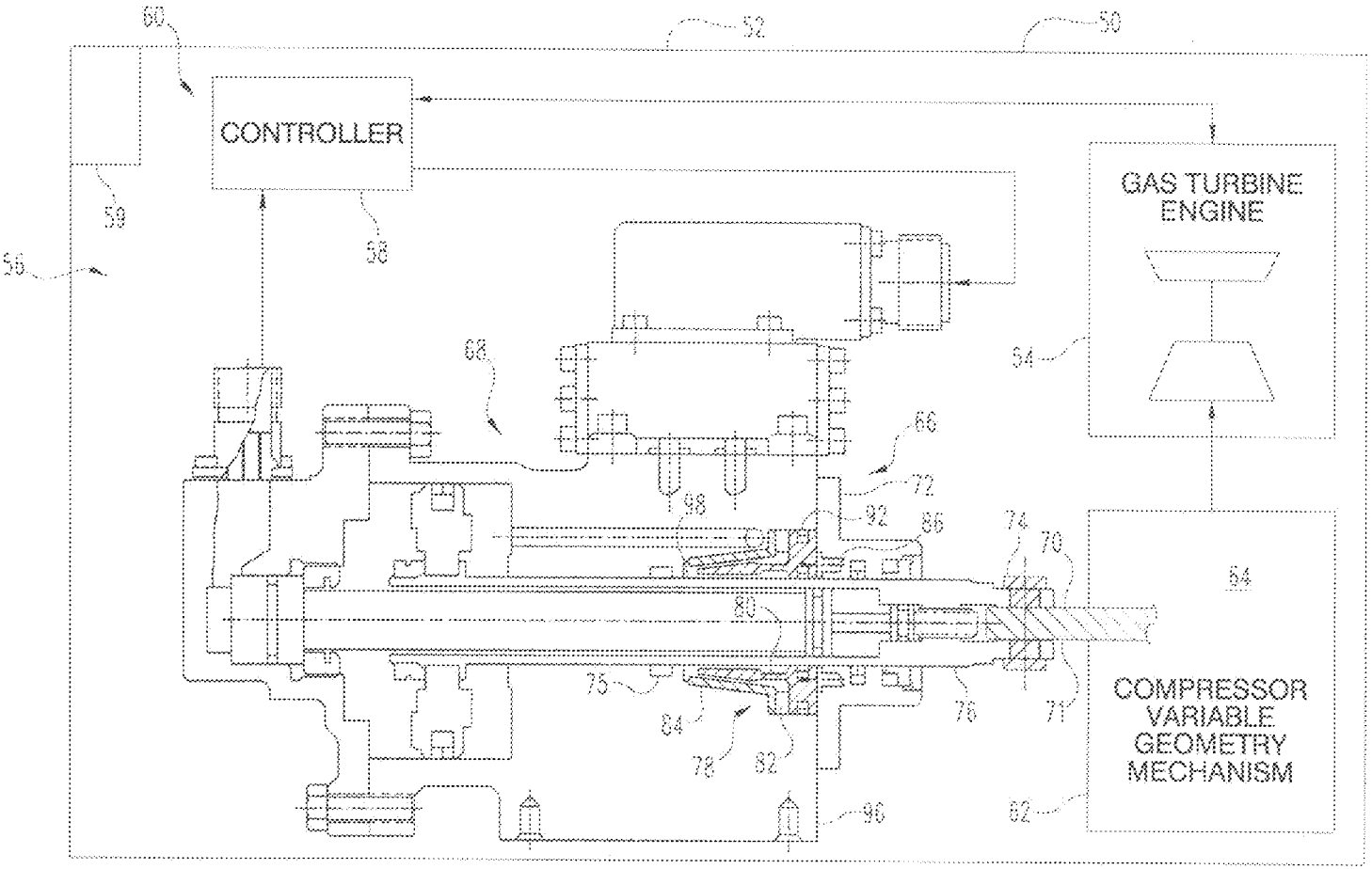
FIG. 1 is a partial, diagrammatic view of a turbomachinery system including an actuation subsystem. The actuation subsystem includes an actuator mechanism shown in partial section form in FIG. 1.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein are contemplated as would normally occur to one skilled in the art to which the invention relates.

FIG. 1 illustrates system 50 of one embodiment of the present invention that includes an aircraft 52 and a gas turbine engine 54. Gas turbine engine 54 provides propulsive, mechanical, and/or electrical power to aircraft 52. In one form, aircraft 52 is of a rotary wing type (such as a helicopter) and the gas turbine engine 54 includes a centrifugal compressor. The gas turbine engine 54, however, can take on other forms in different embodiments, such as, but not limited to, axial flow gas turbine engines, turbojets, turbofans, turboprops, ramjets, and scramjets. The term "aircraft" includes, but is not limited to, helicopters, airplanes, unmanned space vehicles, fixed wing vehicles, variable wing vehicles, rotary wing vehicles, hover crafts, and others. Further, the present inventions are contemplated for utilization in other applications that may not be coupled with an aircraft such as, for example, industrial applications, power generation, pumping sets, naval propulsion and other applications known to one of ordinary skill in the art.

System 50 further includes control subsystem 56 having a controller 58. Controller 58 monitors aircraft performance through a sensor 59 and provides corresponding output signals to various devices. Any number of sensors can be used in any given application. The sensor 59 measures aircraft flight condition such as speed and altitude, to set forth just two non-limiting examples, and can output any variety of data whether sensed or calculated. For example, the sensor 59 can sense and output conditions such as static temperature, static pressure, total temperature, and/or total pressure, among possible others. In addition, the flight condition sensor 59 can output calculated values such as, but not limited to, equivalent airspeed, altitude, and Mach number. Any number of other sensed conditions or calculated values can also be output.

The controller 58 is positioned in avionics bay 60 and can be a single component, or a collection of operatively coupled components. Controller 58 can include digital circuitry, analog circuitry, or a hybrid combination of both of these types. Also, controller 58 can be programmable, an integrated state machine, or a hybrid combination thereof. Controller 58 can include one or more Arithmetic Logic Units (ALUs), Central Processing Units (CPUs), memories, limiters, conditioners, filters, format converters, or the like which are not shown to preserve clarity. In one form, controller 58 is of a programmable variety that executes algorithms and processes data in accordance with operating logic that is defined by programming instructions (such as software or firmware). Alternatively or additionally, operating logic for controller 58 can be at least partially defined by hardwired logic or other hardware. In one particular form, the controller 58 is configured to operate as a Full Authority Digital Engine Control (FADEC); however, in other embodiments it may be organized/configured in a different manner as would occur to those skilled in the art. It should be appreciated that controller 58 can be used in the regulation/control/activation of one or more devices of aircraft 52.

Among the devices that may be controlled with controller 58 is a variable turbomachinery mechanism 62 which, in one non-limiting embodiment, is a compressor variable geometry (CVG) mechanism 64. In still further embodiments, the variable turbomachinery mechanism 62 can take on other moveable forms whether or not associated with the gas turbine engine 54. For example, the variable turbomachinery mechanism 62 can take the form of an aircraft control surface, to set forth just one non-limiting example. CVG Mechanism 64 can be actuated by controller 58 through actuation subsystem 66.

In one non-limiting form the controller 58 can receive position commands, or alternatively generate a desired position of the variable turbomachinery mechanism, which position command or desired position can be compared against a sensed position of the turbomachinery mechanism. Such a comparison can be used within a control regulation scheme to generate commands to actuate the turbomachinery mechanism.

In one form actuation subsystem 66 includes actuation mechanism 68 that is operatively coupled to CVG mechanism 64 by mechanical link 71 in the form of an interconnecting rod 70. The actuation subsystem 66 can be a linearly movable hydraulic ram of a double-acting type. Actuation mechanism 68 can include an actuator 72 with pin 74 connected to interconnecting rod 70 of the CVG mechanism 64. Other types of connections between the actuation mechanism 68 and the CVG mechanism 64 are contemplated herein. Actuator 72 includes an actuator arm 76 that is capable of moving between a first position and a second position at a variety of rates and a position sensor 75 capable of determining the position of the actuator arm 76. The position sensor 75 can take any variety of forms known in the art. To set forth just one non-limiting example, the position sensor 75 can be an LVDT. Although the actuation mechanism 68 is depicted having a linear actuator in the illustrative embodiment, other forms are also contemplated. For example, the actuation mechanism 68 can take the form of a rotary actuator. Whatever the form, the actuation subsystem 66 also includes a brake 78 capable of mechanically discouraging the movement of the actuator arm 76 such that relatively little or no relative movement is conveyed to the variable turbomachinery mechanism 62.

Figure 2:
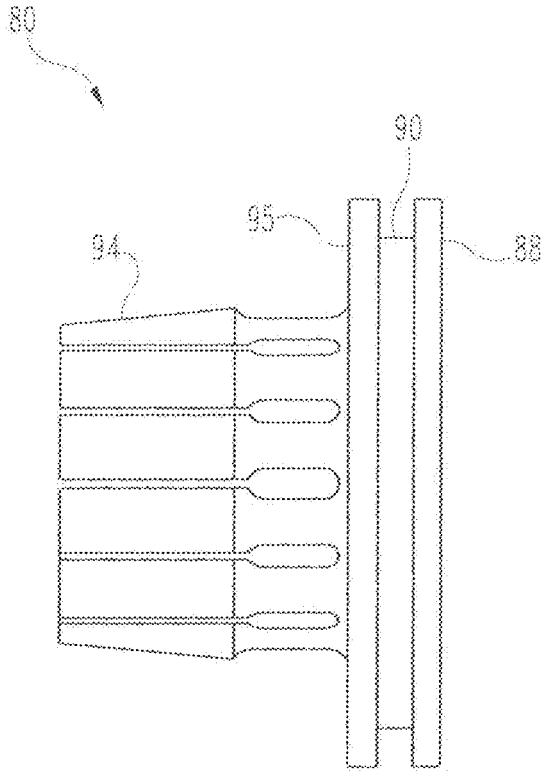
FIG. 2 is a side view of a braking collet included in the actuation mechanism of FIG. 1.

Turning now to FIG. 2, and with continuing reference to FIG. 1, the brake 78 is responsive to a pressure in a working fluid and in one form is operated to selectively contact the actuator arm 76 with a braking force sufficient to maintain the position of the actuator arm 76 relative to actuator 72. The working fluid can be a hydraulic fluid in one non-limiting embodiment. In one form the brake 78 includes a collet 80, a spring 82, and a wear sleeve 84, all of which can have any variety of shapes and forms. The brake 78 is operated when a pressurized working fluid entering through conduit 86 urges the collet 80 to contact the wear sleeve 84. In another form the brake 78 can be operated when a pressurized working fluid urges the wear sleeve 84 into contact with the relatively stationary collet 80.

In one form the collet 80 is annular and includes a face 88, a sealing member 90, and engaging members 94. In the illustrative form the face 88 provides a flat surface which receives a pressurized working fluid but in other embodiments the face 88 can take on a variety of other shapes. The working fluid received by the face 88 can be a hydraulic fluid in one non-limiting example. The sealing member 90 is used to retain a seal 92 that discourages the flow of working fluid from the conduit 86 to the engaging members 94. Any variety of seal 92 can be used, including a piston ring type, among potential others. In some forms the sealing member 90 may be an outward protrusion that engages a surface of a channel within which the collet 80 moves. In one form the engaging members 94 are fingers that are cantilevered and extend from a surface 95 of the collet 80. The engaging members 94 are flexible upon application of a load and can be formed of any suitable material.

The spring 82 provides a force to the collet 80. In the illustrative embodiment, the spring is disposed between the collet 80 and the wear sleeve 84, but may be disposed in other locations in different embodiments. In one non-limiting example, the spring can be disposed between the collet 80 and a housing 96 of the actuation subsystem 66 (shown in FIG. 1 and/or FIGS. 3-6). In one form the spring 82 is a wave spring, but in different embodiments the spring 82 can take on any variety of other forms such as a helical coil spring or a leaf spring, to set forth just a few non-limiting examples. In yet further embodiments, the spring 82 can be an elastomeric member. Multiple springs can be used in some embodiments.

The force imparted on the collet 80 by the working fluid is proportional to an exposed area of the face 88 of the collet 80. In one form the force is opposed by the spring 82 which urges the collet to return to a resting position when the pressure from the working fluid is reduced or removed. When sufficient working fluid pressure is applied to the face 88, the collet 80 is urged away from the conduit 86 and provides a braking force when engaging members 94 are wedged between the wear sleeve 84 and a surface 98 of the actuator. The engaging members 94 can simultaneously engage both the wear sleeve 84 and the surface 98, or can engage one before the other. In some applications the wear sleeve may not be needed.

Turning now to FIGS. 3-6, one embodiment of the present application will be described in relation to various operating conditions. One form of an actuation subsystem 66 includes the actuator arm 76, an actuation valve assembly 100 that is capable of controlling the flow of working fluid to position the actuator arm 76, and a brake valve assembly 102 that is capable of controlling the flow of working fluid to provide a braking capability to the actuator arm 76. The actuation valve assembly 100 includes an actuator spool valve 104 and valve actuator 106 in the illustrative embodiment, but can take other forms in different embodiments. The actuation valve assembly 100 is used to control the flow of working fluid to move the actuator arm 76. The actuation valve assembly 100 is capable of being positioned such that working fluid flows in opposing directions through two pairs of inlets and outlets. The inlets and outlets of the actuation valve assembly 100 change depending on the orientation of the actuation valve assembly 100. In the illustrative form the actuation valve assembly 100 includes a four way spool valve.

The actuator spool valve 104 includes an actuator spool 108 having four actuator spool lands 110 that engage an interior surface of the actuator spool valve 104 and are operable to open and close a number of fluid pathways. The actuator spool lands 110 may have any variety of cross sectional shape suitable to engage the interior surface of the actuator spool valve 104. In one form, the actuator spool lands 110 are cylindrical in shape. Though not depicted in the illustrative embodiment, the actuator spool valve 104 can include a spring that provides a force to the actuator spool 108. The spring can operate by compression, tension, or torsion and can take the form of helical coil springs, cantilever springs, leaf springs, or Belleville washers, to set forth just a few non-limiting examples. In some forms the spring 117 can be an elastomeric member.

The valve actuator 106 is coupled to the actuator spool valve 104 to alter a position of the actuator spool 108. The valve actuator 106 is an electrically powered device capable of responding to a variety of excitation command signals from a control device 112. In the illustrative embodiment, the valve actuator 106 provides a linear movement but in other forms the valve actuator 106 may provide rotary motions. The valve actuator 106 can be a solenoid, stepper motor, servo motor, or piezoelectric motor, among other possible varieties. The valve actuator 106 is "ON" when it is powered and "OFF" when it lacks power to drive the actuator spool valve 104. When "OFF" the valve actuator 106 is configured to move the actuator spool valve 104, and in particular the actuator spool lands 110, to a position towards the right as viewed in FIGS. 3-6 such that conduit 124 is in fluid communication with conduit 140. The position of the actuator spool valve 104 shown in FIG. 6 is an example of the "OFF" position.

The control device 112 can be the controller 58 (shown in FIG. 1) in one form, but in other forms the control device 112 may be a component separate and distinct from the controller 58.

In one form the brake valve assembly 102 includes a brake spool valve 114 and solenoid 116. The brake valve assembly 102 is used to control a flow path either to or from the actuator arm 76 or to the brake 78. The inlets and outlets of the actuation valve assembly 100 change depending on the orientation of the brake valve assembly 102. In the illustrative form the actuation valve assembly 100 includes a three way spool valve.

The brake spool valve 114 includes a brake spool 118 having two brake spool lands 120 in the illustrated embodiment, but may include fewer or more lands in other embodiments. The brake spool lands 120 engage an interior surface of the brake spool valve 114 and are operable to open and close fluid pathways. The brake spool lands 120 can have any variety of cross sectional shape suitable to engage an interior surface of the brake spool valve 114. In one form, the brake spool lands 120 are cylindrical in shape. A spring 117 is disposed within the brake spool valve 114 to provide a force. The spring 117 can operate by compression, tension, or torsion and can take the form of helical coil springs, cantilever springs, leaf springs, or Belleville washers, to set forth just a few non-limiting examples. In some forms the spring 117 can be an elastomeric member.

The solenoid 116 is coupled with the brake spool valve 114 to alter a position of the brake spool 118. In some forms the solenoid 116 can be a stepper motor, servo motor, or piezoelectric motor, among other possible varieties. The solenoid 116 is "ON" when it is powered and "OFF" when it lacks power to drive the brake spool valve 114. When "ON" the solenoid 116 holds the brake spool valve 114 in the position indicated in FIGS. 3-5. When "OFF" the brake spool valve 114, and in particular the brake spool lands 120, is configured to be driven to a position towards the right as viewed in FIG. 6 under the influence of the spring 117. In some forms the spring 117 may reside within the solenoid 116. In the illustrated form, the solenoid 116 provides a linear movement to the actuator spool valve 104, but in other forms the solenoid 116 can provide rotary motion. The solenoid 116 receives commands from the control device 112.

A source 122 provides a working fluid, such as but not limited to a hydraulic fluid, to the actuation subsystem 66. In one form the source is capable of receiving, storing, and pumping the working fluid at a variety of flow rates and/or pressures. In some embodiments the source 122 may be a collection of separate components such as a pump and a tank, to set forth just one possible combination of components.

A number of conduits are used between the source 122, the actuation valve assembly 100, and the brake valve assembly 102 to convey the working fluid in order to move the actuator arm 76. The conduits can have any variety of sizes and shapes and need not be identical to one another. The conduits can be a single, unitary construction or can be an assembly of conduits and unions, among other possible components. In addition, the conduits may be able to convey working fluid in two directions.

Reference will now be made to the particular conduits depicted in the illustrative embodiment. It will be appreciated, however, that additional or fewer conduits may be provided in alternative embodiments. Conduit 124 extends from the source 122 and conveys working fluid toward the actuation valve assembly 100. Conduits 126 and 128 extend from the actuation valve assembly 100 and brake valve assembly 102, respectively, and return working fluid toward the source 122. The conduit 126 is further coupled with conduits 130 and 132. The conduit 128 includes a restrictor 127 in the illustrative embodiment that can be used to provide adequate pressure to activate the brake 78 before flowing through conduit 128. Conduit 134 is disposed between the actuation valve assembly 100 and a chamber 136 used to provide pressure to one side of a reactive member 138. In one form the reactive member 138 is a piston, but in other embodiments the reactive member 138 may take on any variety of other forms. The reactive member 138 is used in the illustrative embodiment to drive and/or otherwise move the actuator arm 76. The conduit 134 is operable to convey working fluid in two directions. Conduit 140 is disposed between the actuation valve assembly 100 and the brake valve assembly 102 and is operated to convey working fluid in two directions. Conduit 86 delivers working fluid toward the brake 78 which may be actuated to provide a force to the actuator arm 76.

Figure 3:
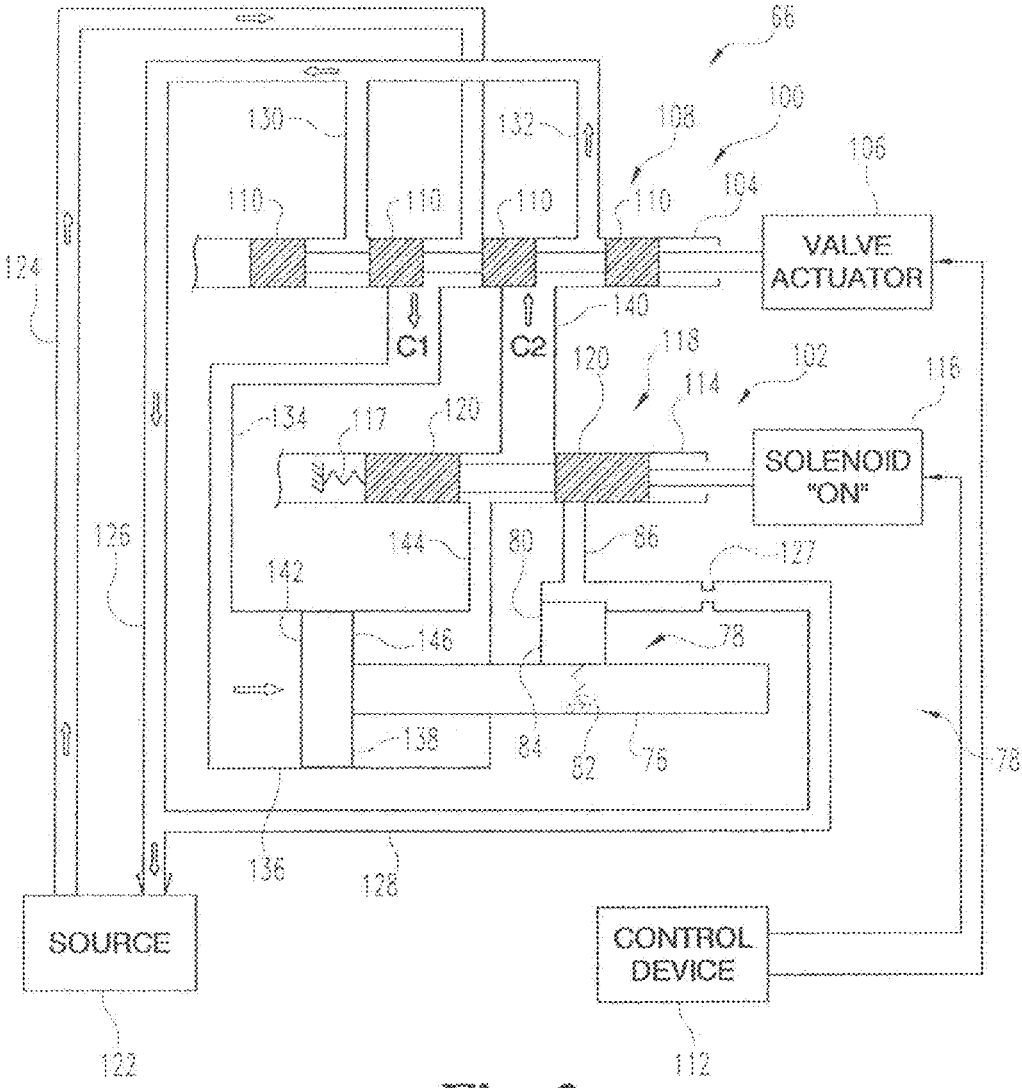
FIGS. 3-6 are schematic diagrams depicting four different operational states of the actuation subsystem of FIG. 1.

When the actuator spool 108 is in the position shown in FIG. 3, the working fluid moves away from the source through conduit 124, it passes between actuator spool lands 110 and through conduit 134 to create a relatively high pressure on surface 142 of reactive member 138. At or near the same time, working fluid moves toward the source 122 through a conduit 144, between the brake spool lands 120, through conduit 140, between actuator spool lands 110, through conduit 132 and through conduit 126. The difference in pressure of the working fluid between the surface 142 and a surface 146 of the reactive member 138 causes the actuator arm 76 to move to the right.

Figure 4:
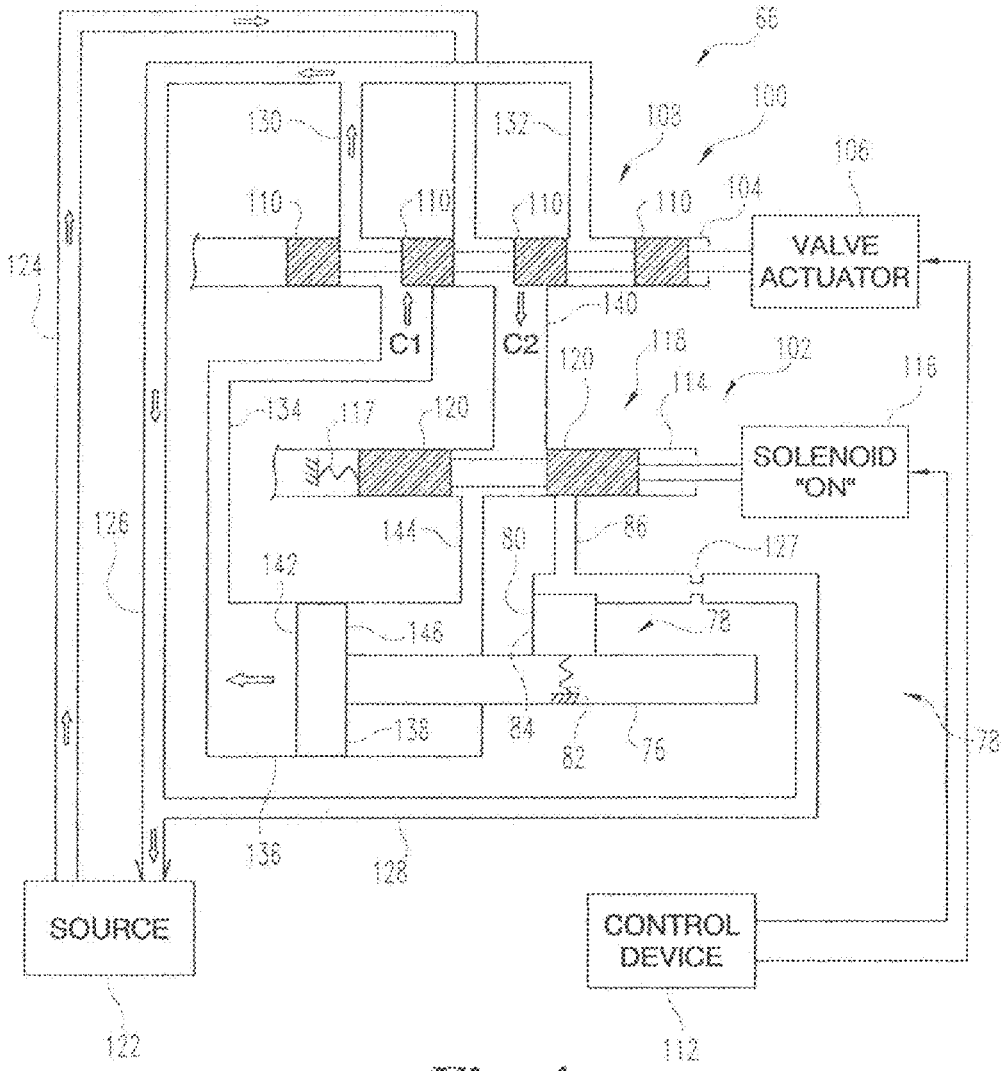

When the actuator spool 108 is in the position shown in FIG. 4, the working fluid moves away from the source through conduit 124, it passes between actuator spool lands 110 and through conduit 140, between brake spool lands 120, and through conduit 144 to create a relatively high pressure on surface 146 of the reactive member 138. At the same time, working fluid moves toward the source 122 through conduit 134, between actuator spool lands 110, through conduit 130 and through conduit 126. The difference in pressure of the working fluid between the surface 142 and a surface 146 of the reactive member 138 causes the actuator arm 76 to move to the left.

Figure 5:
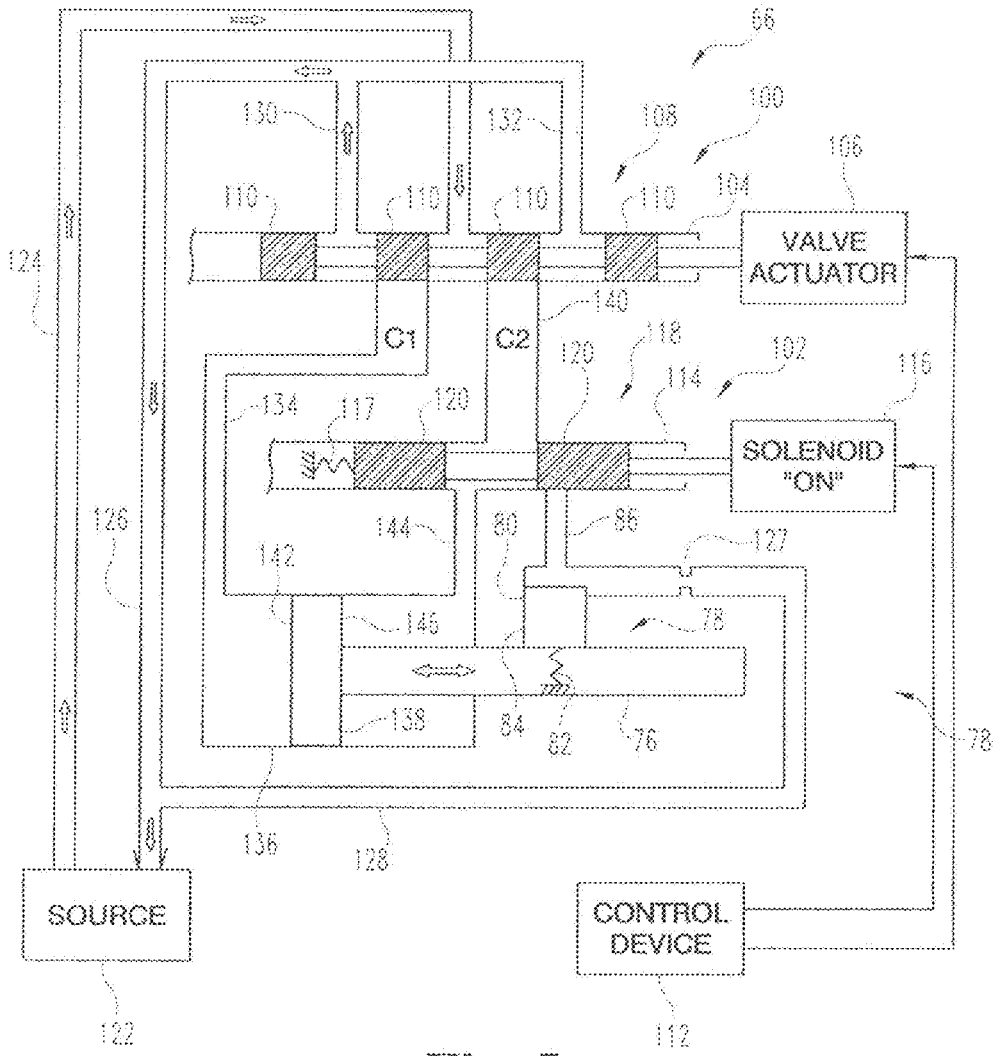
Figure 6:
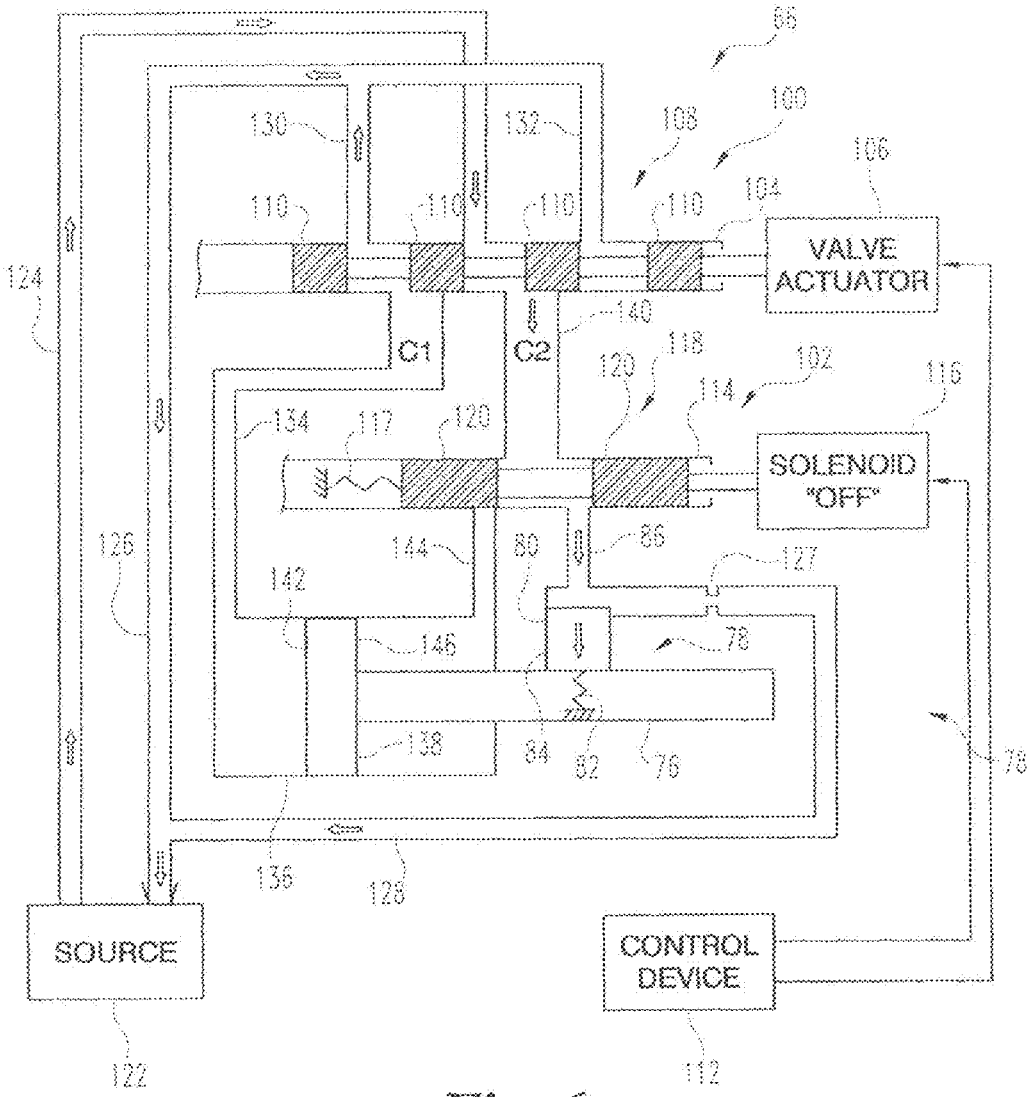

When the actuator spool 108 is in the position shown in FIG. 5, working fluid is discouraged from moving between actuator spool lands 110. In such a situation, the pressure difference between the surfaces 142 and 146 of the reactive member 138 may be small enough, or non-existent, that the actuator arm 76 is relatively stationary. The relatively stationary position of the actuator arm 76 may be maintained in some cases regardless of the pressures and/or flow rates of the working fluid created by the source 122. In some situations, however, the actuator arm 76 may still be moved by other forces. For example, an external force may be applied to the turbomachinery mechanism 62 (shown in FIG. 1) that is large enough to cause some movement in the actuator arm 76, regardless of the position of the actuator spool lands 110.

If the valve actuator 106 and solenoid 116 are placed in the "OFF" condition, the actuator spool 108 and the brake spool 118 are moved to the positions indicated in FIG. 6 to hold the actuator arm 76 in position. The valve actuator 106 and the solenoid 116 can be placed in the "OFF" condition either purposely or through a failure of one or more components. To set forth just a few non-limiting examples, the "OFF" condition can be commanded by the control device 112, or a system electrical failure can deprive the valve actuator 106 and solenoid 116 of electrical power. Other mechanisms, failure modes, or operating conditions can cause the valve actuator 106 and solenoid 116 to be placed in the "OFF" condition.

Turning now to FIG. 6, the brake 78 is engaged by activation of the brake valve assembly 102. When the solenoid 116 is placed in the off condition, the spring 117 assists in urging the brake spool 118 to move to the position shown to discourage flow of working fluid through conduit 144 and instead encourage flow of working fluid through conduit 86. When the working fluid moves away from the source 122 and through conduits 124, 140, and 86, the pressure of the working fluid activates the brake 78, one form of which was described above. The configuration of the actuator spool 108 and the brake spool 118 depicted in FIG. 6 can provide a higher force to keep the actuator arm 76 relatively stationary as opposed to the configuration depicted in FIG. 5. Although an entrance to conduit 130 is not shut off by the actuator spool land 110, some embodiments of the actuator spool 108 can include actuator spool land 110 that does shut off the entrance to conduit 130 thus substantially prohibiting working fluid from moving from either side of the reactive member 138.

In an alternative embodiment, the brake valve assembly 102 may not be coupled with the actuation valve assembly 100 as shown in FIGS. 3-6. In this embodiment, the conduits 140 and 144 can be coupled directly or can be merged into a single conduit and the brake valve assembly 102 can be coupled with conduit 124 such that the brake valve assembly 102 operates to divert working fluid bound for the actuation valve assembly 100 and instead route the working fluid to the brake 78. Working fluid can be routed to actuator brakes used in multiple actuators.

Figure 7:
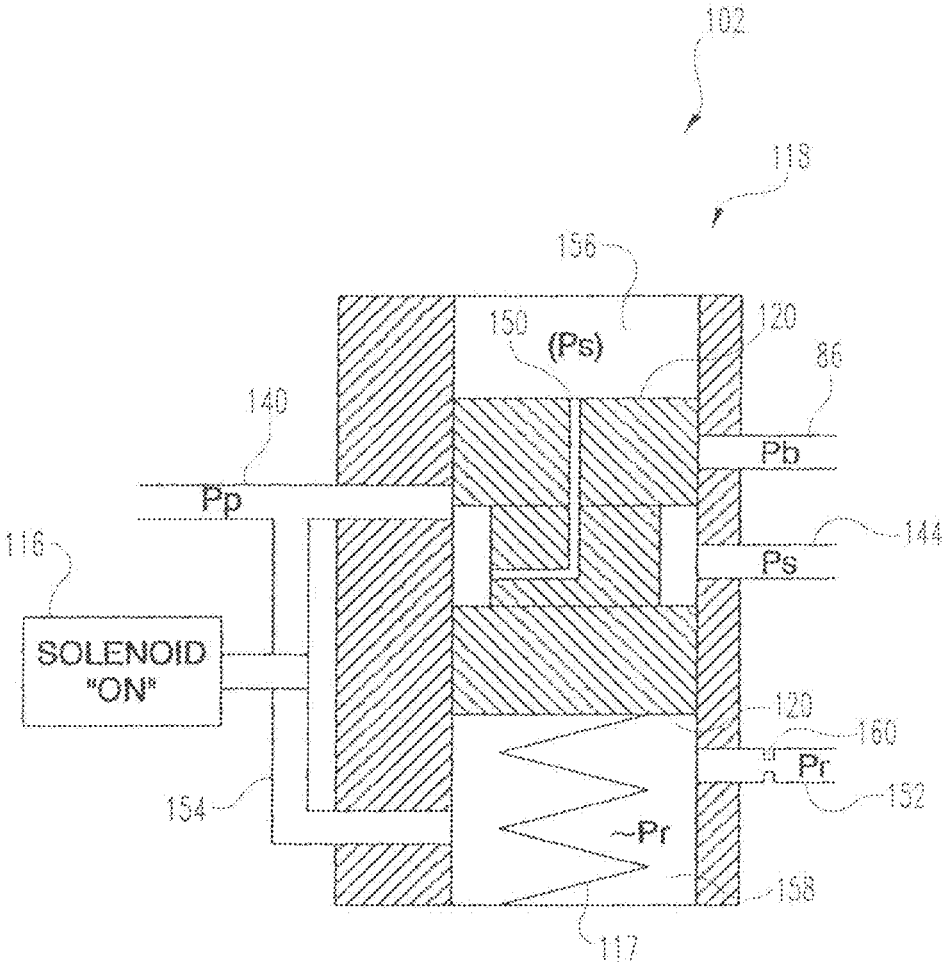
FIGS. 7 and 8 are schematic diagrams of an embodiment of a brake valve.
Figure 8:
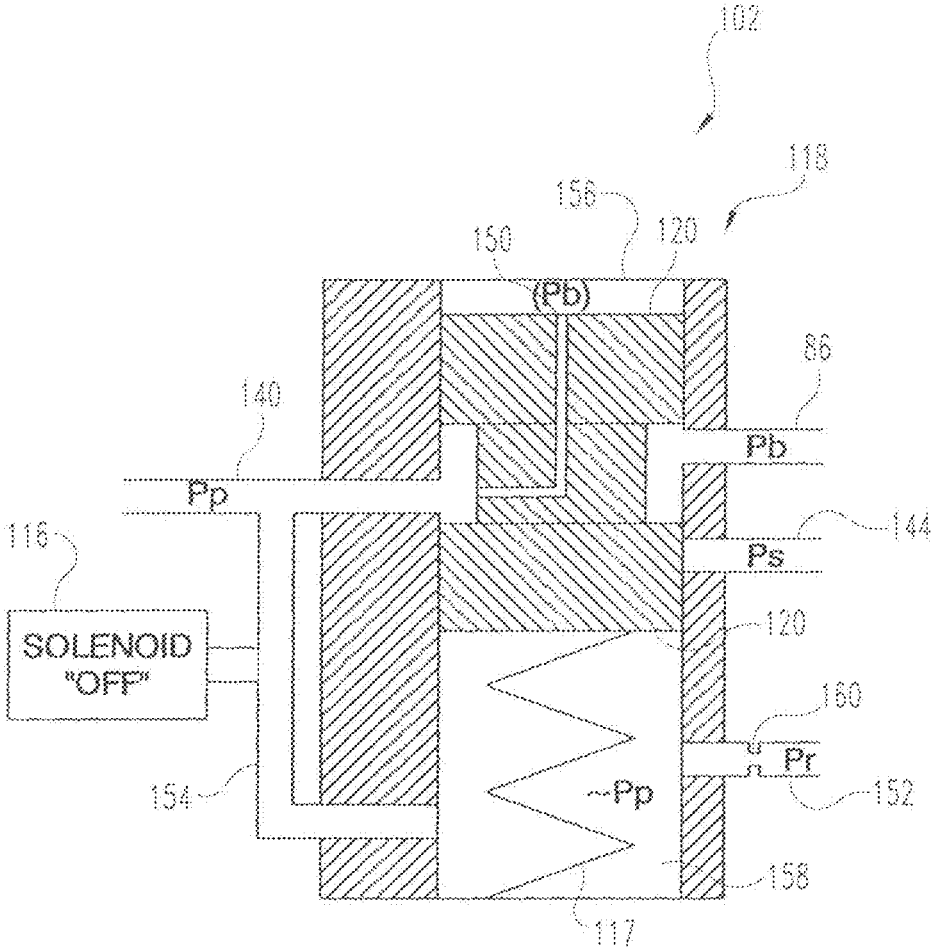

Turning now to FIGS. 7-8, another embodiment of the brake valve assembly 102 will be described in relation to various operating conditions. The form of the brake valve assembly 102 depicted in FIGS. 7-8 includes the brake spool 118, solenoid 116, spring 117, and conduits 86, 144, and 140. Additional features found in FIGS. 7-8 are conduits 150, 152, and 154. The conduit 150 provides a fluid flow path from conduit 140 to chamber 156. The solenoid 116 operates to open or block a fluid pathway between conduits 140 and 154. In operation, when the solenoid 116 is "ON" the working fluid flows through conduits 140 and 150 into chamber 156 creating a pressure at the end of the brake spool land 120. Working fluid also flows into conduit 144 to move the actuator arm 76 (shown in FIG. 1 and/or 3-6). When the solenoid 116 is "OFF" the working fluid also flows through conduit 154 and into chamber 158. When the brake spool lands 120 experience the same or nearly the same pressure of working fluid, the spring 117 urges the brake spool 118 to the position depicted in FIG. 8, thus closing conduit 144 and opening conduit 86. Working fluid flowing through conduit 154 into chamber 158 also flows through conduit 152 and can be returned to the source 122 (shown in FIGS. 3-6). Restrictor 160 can be used to restrict flow and provide adequate pressure in the chamber 158 to urge the brake spool 118 to the position indicated in FIG. 8.

One embodiment of the present application includes a fluid-powered actuation mechanism including a first fluid pathway, a second fluid pathway, a chamber in communication with the first pathway and the second pathway, and actuation member within the chamber, the valve device operable to alternatively placed each one of the first fluid pathway and the second fluid pathway in communication with a fluid supply port while another one of the pathways is in fluid communication with a fluid returned to port to selectively move the member along a range of travel in the chamber. A routing device is also included to provide pressurized fluid to the chamber if power is removed to apply a fluid-powered brake. In one form of this embodiment, the fluid-powered actuation mechanism is provided to control one or more mechanical devices in a gas turbine engine. In alternative forms, the actuation mechanism may be applied in a different manner.

Another embodiment includes moving a member of a fluid-powered actuator in a chamber to correspondingly adjust a variable mechanism of a gas turbine engine in response to a pressurized fluid; in response to a change in operating state of the gas turbine engine, routing at least a portion of the pressurized fluid to activate a fluid-powered brake; and while the brake device is active, applying a braking force to the member with the brake to restrict movement of the member relative to the chamber.

Yet another embodiment includes a gas turbine engine with a fluid-powered actuator. This actuator includes means for moving a member thereof in a chamber to correspondingly adjust a variable mechanism of the gas turbine engine response to a pressurized fluid. In response to a change in operating state of the gas turbine engine, the actuator includes means for routing at least a portion of the pressurized fluid to activate a fluid-powered brake, and means for applying a braking force to the member with the brake to restrict movement of the variable mechanism.

One embodiment of the present application provides a method comprising powering movement of a member of an actuation subsystem with a pressurized fluid to correspondingly adjust a variable mechanism of a gas turbine engine, the variable mechanism being coupled to the member; in response to a change in operating state of the actuation subsystem, bypassing at least a portion of the pressurized fluid from the member to a fluid-powered brake, and in response to the bypassing of the pressurized fluid, applying a braking force to the member with the brake to restrict movement of the member relative to the subsystem.

One form of the present application provides a system comprising a pressurized fluid source including a fluid supply port and a fluid return port; an actuation device including a first fluid pathway, a second fluid pathway, a chamber in fluid communication with the first pathway and the second pathway, an actuation member within the chamber, a valve device operable to alternatively place each one of the first fluid pathway and the second fluid pathway in fluid communication with the fluid supply port while another one of the first fluid pathway and the second fluid pathway is in fluid communication with the fluid return port to selectively move the member along a range of travel in the chamber in opposite directions, a routing device operable to provide pressurized fluid to the chamber if power is applied to the routing device and to divert at least a portion of the pressurized fluid away from the chamber through a third fluid pathway if the power is removed from the routing device, and a fluid-powered brake coupled to the third fluid pathway, the fluid-powered brake being structured to selectively apply a braking force to the member in response to the diverted pressurized fluid in the third fluid pathway; and a turbomachinery mechanism responsive to movement of the member along the range of travel to selectively change configuration while the power is applied to the routing device, the routing device being responsive to removal of the power therefrom to cause the brake to fix position of the member within the chamber and correspondingly brake the turbomachinery mechanism.

Another form of the present application provides an apparatus comprising a gas turbine engine hydraulic actuator in fluid communication with a first fluid pathway and a second fluid pathway and having an actuation member, a first valve device structured to alternatively place each one of the first fluid pathway and the second fluid pathway in fluid communication with a hydraulic fluid input port while another one of the first fluid pathway and the second fluid pathway is in fluid communication with a hydraulic fluid return port to correspondingly move the actuation member of the gas turbine engine hydraulic actuator along a range of travel in opposite directions, a second valve device including a valve body structured to convey pressurized fluid to the actuation member if the valve body is in a first position and route at least a portion of the pressurized fluid away from the gas turbine engine hydraulic actuator through a third fluid pathway if the valve body is in a second position, and an electromechanical device operable to maintain the valve body in the first position when the electromechanical device is in an on condition and operable to provide for movement of the valve body to the second position if the electromechanical device is in an off condition, and a fluid-powered brake coupled to the third fluid pathway, the brake being structured to selectively apply a braking force to the actuation member when the valve body is in the second position.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any of the following claims are desired to be protected.

What is claimed is:

1. A method, comprising:

powering movement of a member of an actuation subsystem with a pressurized fluid to correspondingly adjust a variable mechanism of a gas turbine engine, the variable mechanism being coupled to the member;

in response to a change in operating state of the actuation subsystem, bypassing at least a portion of the pressurized fluid from the member to a fluid-powered brake; and in response to the bypassing of the pressurized fluid, applying a braking force to the member with the brake to restrict movement of the member relative to the subsystem.

2. The method of claim 1, wherein the variable mechanism is a compressor variable geometry mechanism and the change in operating state includes cessation of electric power supplied to the actuation subsystem.

3. The method of claim 1, wherein the member is a piston and the actuation subsystem defines a chamber, the piston is positioned in the chamber and has a linear travel range therein in response to the pressurized fluid, and the pressurized fluid is of a liquid type.

4. The method of claim 1, which further includes:

supplying electrical power to an electromechanical device;

during the supplying of the electrical power, changing position of the member by adjusting a valve to control flow of the pressurized fluid relative to the member;

the change in operating state including halting supply of the electrical power to the electromechanical device to assist the bypassing to the brake to occur; and blocking a pressurized fluid flow to the member during the bypassing to the fluid-powered brake.

5. The method of claim 4, wherein the electromechanical device is in the form of a servo pressure regulator.

6. The method of claim 1, which further includes:

supplying electric power to an electromechanical device to provide a fluid communication pathway between a pressurized fluid reservoir and a chamber of the actuation subsystem, the member being positioned in the chamber; and halting supply of the electric power to the electromechanical device to provide a different fluid communication passageway between the reservoir and the brake.

7. The method of claim 6, wherein:

the electromechnical device includes a solenoid and a spring-loaded valve body;

the powering of the movement of the member including opposing a spring bias applied to the valve body during the supplying of the electric power to the solenoid, the valve body being in a first position defining at least a portion of the fluid communication pathway; and the bypassing to the fluid-powered brake including moving the valve body from the first position to a second position under influence of the spring bias to define the different fluid communication pathway in response to the halting of the electric power to the solenoid.

8. The method of claim 7, which further includes reapplying the electric power to the solenoid to move the spring-loaded valve body from the second position back to the first position after the bypassing in response to a further change in operating state of the actuation mechanism.

9. The method of claim 1, which further includes:

during the powering of the movement of the member, sensing position of the member along a range of travel within a chamber of the actuation mechanism to provide a corresponding sensor signal;

in response to the sensor signal, selectively adjusting an actuator valve to control the movement of the member along the range of travel; and adjusting a brake valve to perform the bypassing to the brake, the member being fixed in position relative to the range of travel in response to the braking force.

10. A system, comprising:

a pressurized fluid source including a fluid supply port and a fluid return port;

an actuation device including a first fluid pathway, a second fluid pathway, a chamber in fluid communication with the first pathway and the second pathway, an actuation member within the chamber, a valve device operable to alternatively place each one of the first fluid pathway and the second fluid pathway in fluid communication with the fluid supply port while another one of the first fluid pathway and the second fluid pathway is in fluid communication with the fluid return port to selectively move the member along a range of travel in the chamber in opposite directions, a routing device operable to provide pressurized fluid to the chamber if power is applied to the routing device and to divert at least a portion of the pressurized fluid away from the chamber through a third fluid pathway if the power is removed from the routing device, and a fluid-powered brake coupled to the third fluid pathway, the fluid-powered brake being structured to selectively apply a braking force to the member in response to the diverted pressurized fluid in the third fluid pathway; and a turbomachinery mechanism responsive to movement of the member along the range of travel to selectively change configuration while the power is applied to the routing device, the routing device being responsive to removal of the power therefrom to cause the brake to fix position of the member within the chamber and correspondingly brake the turbomachinery mechanism.

11. The system of claim 10, which further includes a gas turbine engine, the turbomachinery mechanism being a compressor variable geometry mechanism for the gas turbine engine.

12. The system of claim 11, which further includes means for sensing position of the actuation member along the range of travel, means for determining a desired arrangement of the compressor variable geometry mechanism in response to a sensor signal representative of the position from the sensing means, and means for controlling the valve device to selectively adjust the position of the actuation member to provide the desired arrangement.

13. The system of claim 10, wherein the routing device includes a valve body structured to define a portion of at least one of the first pathway and the second pathway when in a first position maintained by applying the power to the routing device, and the valve body being structured to at least partially block one or more of the first pathway and the second pathway to connect the third pathway.

14. The system of claim 10, which further includes a spring disposed within the routing device and an electromechanical device operable to open and close a fourth fluid pathway in fluid communication with an end of the routing device.

15. The system of claim 10, wherein the routing device includes means for routing fluid to a selected one of two different passages.

16. The system of claim 10, wherein the routing device includes a spring loaded valve body and a solenoid responsive to the power to oppose a spring bias to maintain the valve body in a first position and to permit movement of the valve body to a second position under influence of the spring bias when the power is removed.

17. An apparatus, comprising:

a gas turbine engine hydraulic actuator in fluid communication with a first fluid pathway and a second fluid pathway and having an actuation member;

a first valve device structured to alternatively place each one of the first fluid pathway and the second fluid pathway in fluid communication with a hydraulic fluid input port while another one of the first fluid pathway and the second fluid pathway is in fluid communication with a hydraulic fluid return port to correspondingly move the actuation member of the gas turbine engine hydraulic actuator along a range of travel in opposite directions;

a second valve device including a valve body structured to convey pressurized fluid to the actuation member if the valve body is in a first position and route at least a portion of the pressurized fluid away from the gas turbine engine hydraulic actuator through a third fluid pathway if the valve body is in a second position, and an electromechanical device operable to maintain the valve body in the first position when the electromechanical device is in an on condition and operable to provide for movement of the valve body to the second position if the electromechanical device is in an off condition; and a fluid-powered brake coupled to the third fluid pathway, the brake being structured to selectively apply a braking force to the actuation member when the valve body is in the second position.

18. The apparatus of claim 17, wherein the valve body routes fluid through at least one of the first fluid pathway and the second pathway in the first position and blocks the fluid from one or more of the first pathway and the second pathway in the second position.

19. The apparatus of claim 17, wherein the electromechanical device is coupled with the valve body and operable to move the valve body between the first position and second position.

20. The apparatus of claim 17, which further includes a spring disposed within the second valve device and operable to apply a force to the valve body, wherein the electromechanical device is operable to control a flow of fluid in an electromechanical device fluid pathway, the spring and a pressure of the fluid operable to move the valve body between the first position and the second position.

21. The apparatus of claim 17, wherein the apparatus includes a pressurized fluid source, the source includes a pump, the second valve device includes a servo regulator in fluid communication with the pump and being coupled to the fluid input port and the fluid return port.

22. The apparatus of claim 17, wherein the actuation member actuates a compressor variable geometry mechanism and the brake includes a collet positioned about a portion of the actuation member.

23. The apparatus of claim 17, wherein the electromechanical device is in the on condition when electrical power is provided to the electromechanical device, and wherein the electromechanical device is in the off condition when electrical power is removed from the electromechanical device.

* * * * *